US011111771B2

(12) United States Patent
Kumaran

(10) Patent No.: US 11,111,771 B2
(45) Date of Patent: Sep. 7, 2021

(54) METHODS OF DRILLING A WELLBORE WITHIN A SUBSURFACE REGION AND DRILLING CONTROL SYSTEMS THAT PERFORM THE METHODS

(71) Applicant: Krishnan Kumaran, Raritan, NJ (US)

(72) Inventor: Krishnan Kumaran, Raritan, NJ (US)

(73) Assignee: ExxonMobil Upstream Research Company, Spring, TX (US)

( * ) Notice: Subject to any disclaimer, the term of this patent is extended or adjusted under 35 U.S.C. 154(b) by 680 days.

(21) Appl. No.: 16/022,174

(22) Filed: Jun. 28, 2018

(65) Prior Publication Data

US 2019/0048704 A1 Feb. 14, 2019

Related U.S. Application Data

(60) Provisional application No. 62/608,242, filed on Dec. 20, 2017, provisional application No. 62/545,120, filed on Aug. 14, 2017.

(51) Int. Cl.
*E21B 44/02* (2006.01)
*E21B 47/12* (2012.01)
(Continued)

(52) U.S. Cl.
CPC ..... *E21B 44/02* (2013.01); *E21B 3/02* (2013.01); *E21B 45/00* (2013.01); *E21B 47/06* (2013.01); *E21B 47/12* (2013.01)

(58) Field of Classification Search
CPC ..... G06F 30/00; E21B 2200/20; E21B 44/02; E21B 3/02; E21B 45/00; E21B 47/06; E21B 47/12
(Continued)

(56) References Cited

U.S. PATENT DOCUMENTS 5,704,436 A 1/1998 Smith et al.
5,794,720 A 8/1998 Smith et al.
(Continued)

FOREIGN PATENT DOCUMENTS

WO WO 2014/160625 A1 10/2014

OTHER PUBLICATIONS

Queslati, Hatem et al., "New Insights into Drilling Dynamics through High-Frequency Vibration Measurement and Modeling", Sep. 30-Oct. 2, 2013, SPE Annual Technical Conference and Exhibition, Society of Petroleum Engineers. (Year: 2013).*

*Primary Examiner* — Cedric Johnson
(74) *Attorney, Agent, or Firm* — ExxonMobil Upstream Research Company-Law Department

(57) ABSTRACT

Methods of drilling a wellbore within a subsurface region and drilling control systems that perform the methods. The methods include accessing an objective map and calculating a plurality of critical points of the objective map. The methods also include scoring each critical point and selecting a selected critical point of the plurality of critical points. The selected critical point describes an estimated value of at least one drilling performance indicator for a selected value of at least one independent operational parameter. The methods further include operating the drilling rig at the selected value of the at least one independent operational parameter and, during the operating, determining an actual value of the at least one drilling performance indicator. The methods also include updating the objective map to generate an updated objective map and repeating at least a portion of the methods.

27 Claims, 7 Drawing Sheets

(51) Int. Cl.
*E21B 3/02* (2006.01)
*E21B 45/00* (2006.01)
*E21B 47/06* (2012.01)

(58) Field of Classification Search
USPC ..... 703/10, 6; 403/10, 6
See application file for complete search history.

(56) References Cited

U.S. PATENT DOCUMENTS 6,026,912 A 2/2000 King et al.
6,293,356 B1 9/2001 King et al.
6,382,331 B1 5/2002 Pinckard
6,386,297 B1 5/2002 Cooley et al.
6,408,953 B1 6/2002 Goldman et al.
6,424,919 B1 7/2002 Moran et al.
6,732,052 B2 5/2004 MacDonald et al.
6,968,909 B2 11/2005 Aldred et al.
7,085,696 B2 8/2006 King
7,172,037 B2 2/2007 Dashevskiy et al.
7,357,196 B2 4/2008 Goldman et al.
9,436,173 B2 9/2016 Wang et al.
9,482,084 B2 11/2016 Chang et al.
9,598,947 B2 3/2017 Wang et al.
2005/0267719 A1 12/2005 Foucault
2007/0185696 A1 8/2007 Moran et al.
2008/0255817 A1 10/2008 Pabon et al.
2008/0262810 A1 10/2008 Moran et al.
2009/0090555 A1 4/2009 Boone et al.
2009/0114445 A1 5/2009 Dashevskiy
2009/0132458 A1 5/2009 Edwards et al.
2009/0152005 A1 6/2009 Chapman et al.
2009/0198478 A1 8/2009 Cuevas et al.
2009/0250264 A1 10/2009 Dupriest
2010/0155142 A1 6/2010 Thambynayagam et al.
2010/0259415 A1 10/2010 Strachan et al.
2012/0123757 A1 5/2012 Ertas et al.
2012/0130693 A1 5/2012 Ertas et al.
2013/0144531 A1 6/2013 Johnston
2014/0277752 A1* 9/2014 Chang ..... E21B 44/00 700/275
2016/0054729 A1 2/2016 Payette
2016/0117424 A1* 4/2016 Hohl ..... E21B 44/00 703/2
2016/0281490 A1 9/2016 Samuel
2017/0058657 A1 3/2017 Spivey et al.

* cited by examiner

METHODS OF DRILLING A WELLBORE WITHIN A SUBSURFACE REGION AND DRILLING CONTROL SYSTEMS THAT PERFORM THE METHODS

CROSS REFERENCE TO RELATED APPLICATIONS

This application claims the benefit of U.S. Provisional Application Ser. No. 62/608,242 filed Dec. 20, 2017 and U.S. Provisional Application Ser. No. 62/545,120 filed Aug. 14, 2017, the disclosures of which are incorporated herein by reference in their entirety.

FIELD OF THE DISCLOSURE

The present disclosure is directed to methods of drilling a wellbore within a subsurface region and to drilling control systems that perform the methods.

BACKGROUND OF THE DISCLOSURE

The oil and gas industry incurs substantial operating costs to drill wells during the exploration and/or development of hydrocarbon resources. The cost of drilling wells may be considered to be a function of time, as the incurred equipment and manpower expenses generally are time-based. Drilling time may be decreased by increasing Rate-of-Penetration (ROP), or the rate at which a drill bit penetrates the earth. Additionally or alternatively, drilling time also may be decreased by decreasing non-drilling rig time, examples of which include time spent tripping equipment into and/or out of the well, such as to replace or repair the equipment, time spent constructing the well during drilling, such as to install casing, and/or time spent performing other treatments on the well. Past efforts have attempted to address each of these approaches. For example, drilling equipment constantly is evolving to improve both the longevity of the equipment and the effectiveness of the equipment at promoting a higher ROP. Moreover, various efforts have been made to model and/or control drilling operations to avoid equipment-damaging and/or ROP-limiting conditions, such as vibrations, bit-balling, etc.

Some attempts to reduce the costs of drilling operations have focused on increasing ROP. For example, U.S. Pat. Nos. 6,026,912, 6,293,356, and 6,382,331 each provide models and equations for use in increasing the ROP. The disclosures of these patents are incorporated by reference herein. In the methods disclosed in these patents, the operator collects data regarding a drilling operation and identifies a single control variable that can be varied to increase the ROP. In most examples, the control variable is weight-on-bit (WOB); the relationship between WOB and ROP is modeled; and the WOB is varied to increase the ROP. While these methods may result in an increased ROP at a given point in time, this specific parametric change may not be in the best interest of the overall drilling performance in all circumstances. In addition, these methods may be ineffective when drilling conditions are highly variable. Thus, there exists a need for improved methods of drilling a wellbore within a subsurface region and/or for drilling control systems that perform the methods.

SUMMARY OF THE DISCLOSURE

Methods of drilling a wellbore within a subsurface region and drilling control systems that perform the methods. The methods drill the wellbore within a subsurface region with a drill string of a drilling rig. The methods include accessing an objective map and calculating a plurality of critical points of the objective map. The objective map describes at least one estimated drilling performance indicator as a function of at least one independent operational parameter of the drilling rig.

The methods also include scoring each critical point and selecting a selected critical point of the plurality of critical points. The selecting is based, at least in part, on the scoring. The selected critical point describes an estimated value of the at least one drilling performance indicator for a selected value of at least one independent operational parameter.

The methods further include operating the drilling rig at the selected value of the at least one independent operational parameter and, during the operating, determining an actual value of the at least one drilling performance indicator. The methods also include updating the objective map to generate an updated objective map. The updating is based upon the actual value of the at least one independent operational parameter of the drilling rig.

The methods further include repeating at least a portion of the methods. The repeating includes repeating, with the updated objective map, at least the calculating, the scoring, the selecting, the operating, the determining, and the updating a plurality of times to iteratively improve an estimate of the at least one drilling performance indicator that is provided by the updated objective map.

DETAILED DESCRIPTION AND BEST MODE OF THE DISCLOSURE

Figure 1:
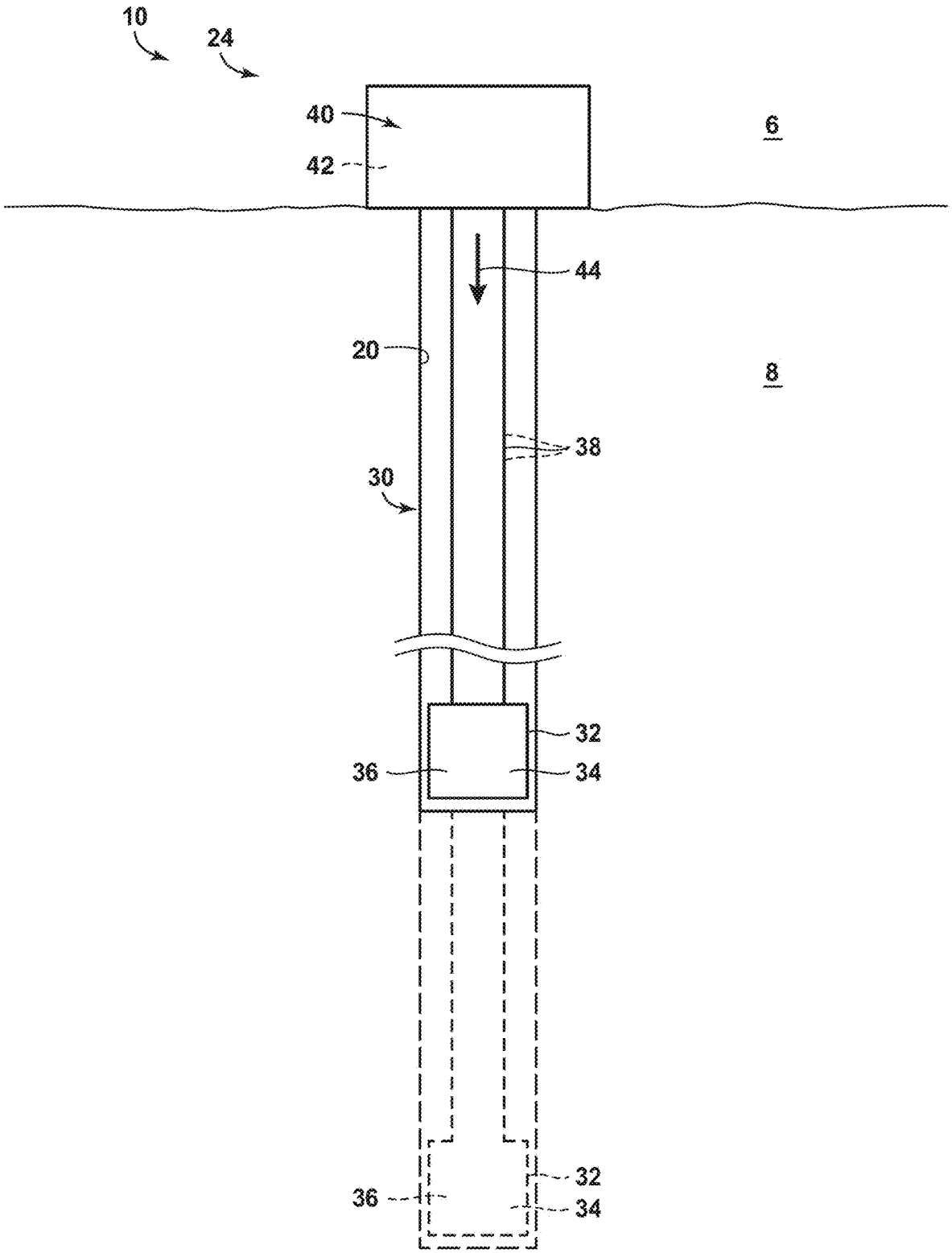
FIG. 1 is a schematic illustration of a well, such as may be formed according to the present disclosure.

FIG. 1 is a schematic illustration of a well 10, such as which may be drilled, or otherwise formed, according to the present disclosure. Well 10 includes a wellbore 20 that extends within a subsurface region 8. Well 10 also may be referred to herein as extending between a surface region 6 and subsurface region 8 and/or as extending with a subterranean formation that extends within the subsurface region.

As illustrated, well 10 also includes a drilling rig 24 that includes a drill string 30 extending within wellbore 20. Drill string 30 includes a bottom hole assembly 32, which includes a drill bit 34. Drill string 30 also includes at least one detector 36. Detector 36 is configured to detect at least one parameter indicative of a drilling performance indicator of drill string 30. Drill string 30 further may include one or more lengths of drill pipe 38. Drill pipe 38 may extend at least partially between bottom hole assembly 32 and surface region 6 and may provide mechanical, electrical, and/or fluid communication between the bottom hole assembly and the surface region.

Well 10 further includes a drilling control system 40. Drilling control system 40 is configured to control the operation of drilling rig 24, such as via and/or by utilizing a controller 42. When present, controller 42 may execute and/or implement any of the methods 200 described herein. The control of the operation of drilling rig 24 may include controlling the revolutions per minute (RPM) of the drill string, controlling the weight-on-bit (WOB) applied to the drill bit by the drilling rig, and/or controlling any suitable independent operational parameter of a drilling operation that utilizes the drilling rig and/or the drill string. The control of the operation of drilling rig 24 may be accomplished in any suitable manner. As an example, drilling control system 40 and/or controller 42 thereof, may control the operation of drilling rig 24 according to any suitable step and/or steps of methods 200, which are disclosed herein.

During operation of drilling rig 24, the drilling rig, including drill string 30 and drilling control system 40 thereof, may be utilized to drill, or to increase a length of, wellbore 20. This is illustrated schematically in dashed lines in FIG. 1. This may include rotating drill bit 34 within the wellbore. A drilling mud 44 may be provided to drill bit 34, via drill pipe 38. The drilling mud may be provided to balance pressure within the wellbore, cool the drill bit, lubricate the drill bit, and/or remove cuttings from the wellbore.

During such a drilling operation, drilling rig 24 and/or drill bit 34 thereof may come into contact with, or may drill through, regions of subsurface region 8 that include, or are defined by, varying, or different, subterranean strata. Conventional drilling control systems may be configured to effectively control the operation of conventional drilling rigs when there is little variation in subterranean strata and/or when any variation occurs over relatively long length scales (such as length scales on the order of meters, tens-of-meters, or more). However, such conventional drilling control systems may be unable to effectively control the operation of conventional drilling rigs when variation in subterranean strata occurs over relatively short length scales (such as length scales of less than a meter, less than half of a meter, and/or less than a tenth of a meter).

In contrast, drilling control systems 40, which are disclosed herein, may be configured to effectively control the operation of drilling rig 24 when the variation in subterranean strata occurs over both the relatively long length scales and the relatively short length scales. To this end, and as discussed in more detail herein with reference to methods 200 of FIG. 2, drilling control systems 40 may selectively explore the impact of various independent operational parameters of drilling rig 24 on various drilling performance indicators of the drilling rig. Drilling control systems 40 then may utilize this information to provide, or to improve, an objective map, which provides an estimate of at least one drilling performance indicator as a function of at least one independent operational parameter, thereby permitting the drilling control system to anticipate, and/or to effectively respond to, variations in subterranean strata.

As also discussed herein with reference to methods 200, drilling control systems 40 may be configured to balance exploration and exploitation. Exploration may be utilized to further quantify the impact of the various independent operational parameters on the various drilling performance indicators and may be preferred in situations in which the relationship between the drilling performance indicators and the independent operational parameters is unknown, or is not well known. Exploitation may operate the drill rig under conditions that produce a desired, or optimal, value for the various drilling performance indicators and may be preferred in situations in which the relationship between the drilling performance indicators and the independent operational parameters is well-known and/or established. As such, drilling control systems 40, which are disclosed herein, initially may operate in an exploratory mode, thereby permitting the drilling control systems to quantify the relationship between the drilling performance indicators and the independent operational parameters. Once this relationship is understood, the drilling control systems automatically may transition to operation in an exploitation mode, where the known relationship between the drilling performance indicators and the independent operational parameters may be utilized to provide desired and/or improved operation of the drill rig.

Figure 2:
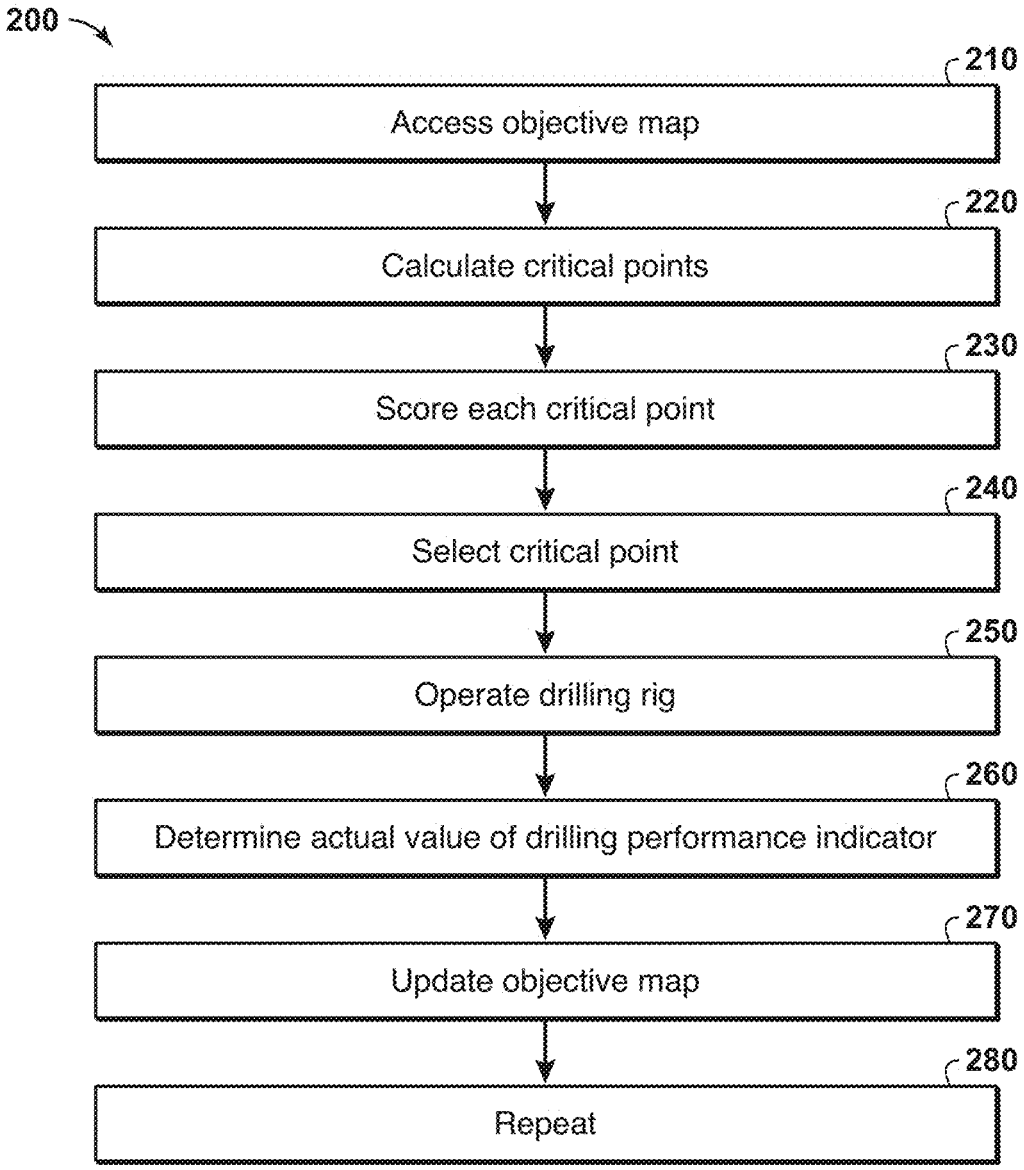
FIG. 2 is a flowchart depicting methods, according to the present disclosure, of drilling a wellbore within a subsurface region with a drill string of a drilling rig.

FIG. 2 is a flowchart depicting methods 200, according to the present disclosure, of drilling a wellbore within a subsurface region with a drill string of a drilling rig. Methods 200 include accessing an objective map at 210, calculating critical points at 220, and scoring each critical point at 230. Methods 200 also include selecting a selected critical point at 240, operating the drilling rig at 250, and determining an actual value of a drilling performance indicator at 260. Methods 200 further include updating an objective map at 270 and repeating at least a portion of the methods at 280.

Accessing the objective map at 210 may include receiving, obtaining, downloading, creating, formulating, and/or calculating any suitable objective map. The objective map describes, correlates, and/or quantifies at least one estimated drilling performance indicator of the drilling rig as a function of at least one independent operational parameter of the drilling rig.

The accessing at 210 may be performed in any suitable manner. As an example, the accessing at 210 may include accessing, obtaining, and/or downloading the objective map from an objective map database, or from a predetermined and/or pre-established objective map database.

As another example, the accessing at 210 may include generating the objective map. This may include drilling, with the drill string, an initial portion of the wellbore. Under these conditions, the drilling the initial portion of the wellbore may include varying the at least one independent operational parameter over a plurality of, or a plurality of selected, independent operational parameter values. The drilling the initial portion of the wellbore also may include collecting the actual value of the at least one drilling performance indicator for each of the plurality of independent operational parameter values. The drilling the initial portion of the wellbore further may include generating the objective map based upon the actual value of the at least one drilling performance indicator for each, or the at least one drilling performance indicator obtained at each, of the plurality of independent operational parameter values.

The drilling the initial portion of the wellbore also may include maintaining a fixed, or at least substantially fixed, value of the at least one independent operational parameter for at least a threshold drilling time. Under these conditions, the drilling the initial portion of the wellbore also may include collecting a plurality of intermediate values of the at least one drilling performance indicator during the threshold drilling time. The actual value of the at least one drilling performance indicator may be based, at least in part, on the plurality of intermediate values of the at least one drilling performance indicator. As an example, the actual value of the at least one drilling performance indicator may include and/or be an average, or mean, of the plurality of intermediate values of the at least one drilling performance indicator.

The threshold drilling time, when utilized, may be selected and/or determined in any suitable manner. As an example, the threshold drilling time may be selected such that, during the threshold drilling time, the drilling the initial portion of the wellbore includes increasing a length of the initial portion of the wellbore by at least a threshold length increment. Examples of the threshold length increment include at least 5 centimeters (cm), at least 10 cm, at least 20 cm, at least 30 cm, at least 40 cm, at least 50 cm, at most 10 meters (m), at most 8 m, at most 6 m, at most 4 m, at most 2 m, at most 1 m, at most 50 cm, at most 40 cm, at most 30 cm, and/or at most 20 cm.

The at least one independent operational parameter may include any suitable number of independent operational parameters. As an example, the at least one independent operational parameter may include a single independent operational parameter. As additional examples, the at least one independent operational parameter may include a plurality of independent operational parameters, such as at least 2, 2, at least 3, 3, at least 4, or 4 independent operational parameters.

Independent operational parameters are system parameters that may be directly controlled, regulated, and/or selected by an operator of the drilling rig. Examples of the independent operational parameters include one or more of a revolutions per minute (RPM) of the drill string, a weight-on-bit (WOB) applied to a drill bit by the drill string, a flow rate of drilling mud provided to the drill bit by the drill string, and/or a pressure differential of the drilling mud across the drill bit. RPM refers to a number of revolutions per minute for the drill bit during drilling of the wellbore. WOB refers to a weight, or force, that is applied to a drill bit of a drilling rig during drilling a wellbore. WOB may be related to a normal force between the drill bit and the subterranean formation during drilling of the wellbore. The flow rate of drilling mud refers to the flow rate of drilling mud to the wellbore, through a drill string of the drilling rig, and/or into contact with the drill bit. The pressure differential refers to the pressure differential of the drilling mud, across the motor and/or drill bit, when the drilling mud is being supplied into contact with the drill bit via the drill string.

The at least one drilling performance indicator may include any suitable number of drilling performance indicators. As an example, the at least one drilling performance indicator may include a single drilling performance indicator. As additional examples, the at least one drilling performance indicator may include a plurality of drilling performance indicators, such as at least 2, 2, at least 3, 3, at least 4, or 4 drilling performance indicators.

Drilling performance indicators may be parameters that are not directly controlled by the operator of the drilling rig and/or that result from operating the drilling rig according to a set of independent operational parameters. Examples of the drilling performance indicators include one or more of a rate of penetration (ROP) of the drill string into the subterranean formation, a mechanical specific energy (MSE) of the drilling rig while drilling the wellbore, a hole clearing indicator of the wellbore, a vibrational dysfunction of the drilling rig while drilling the wellbore, a torsional severity estimate (TSE) of the drilling rig while drilling the wellbore, a drill bit wear parameter, a bottom hole assembly wear parameter, a depth of cut (DOC), a ratio of DOC to WOB, a torque applied to the drill bit while drilling the wellbore, and/or a vibration of the drill bit while drilling the wellbore.

The objective map may include and/or be any suitable objective map. As an example, the objective map may include a two-dimensional objective map that describes the at least one estimated drilling performance indicator as a function of a single independent operational parameter. As another example, the objective map may include a three-dimensional objective map that describes the at least one estimated drilling performance indicator as a function of two distinct independent operational parameters, examples of which are disclosed herein.

The objective map may define a smooth and/or a continuous objective surface. As an example, the objective map may include and/or be a fit to a plurality of data points. Under these conditions, each of the plurality of data points may include a determined and/or measured value of the at least one drilling performance indicator for, or as a function of, a corresponding value of the at least one independent operational parameter. Examples of the fit include a curve fit, a polynomial fit, and/or a functional fit. The fit may be defined by a continuous function and/or by a differentiable function. As such, the fit may provide a single estimated value of the drilling performance indicator for each permissible value of the at least one independent operational parameter.

Figure 3:
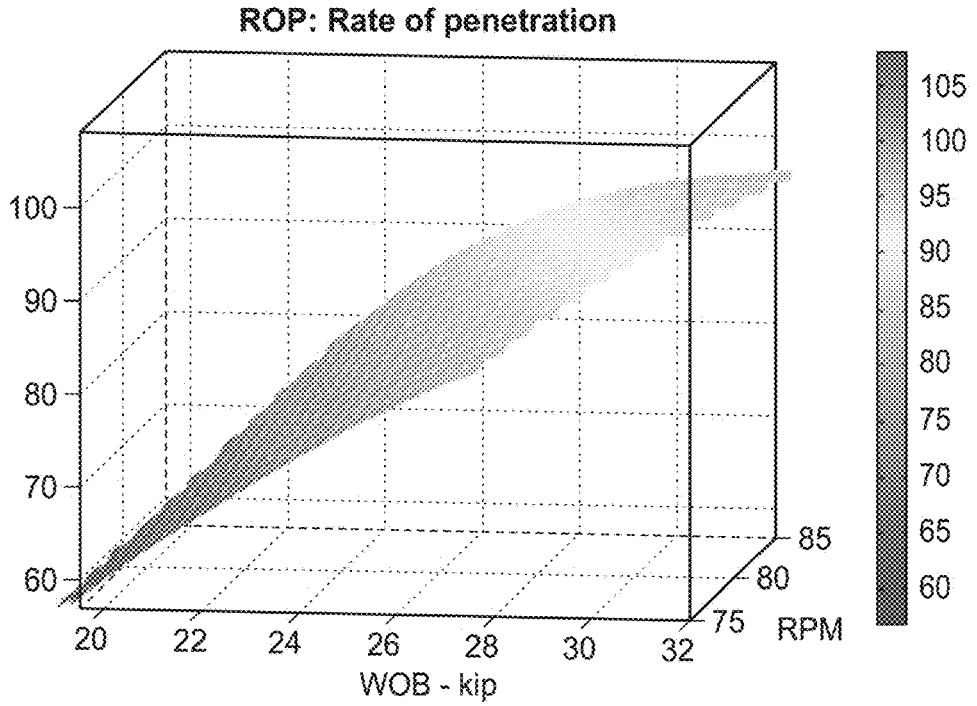
FIG. 3 is a plot illustrating rate of penetration as a function of weight on bit and revolutions per minute that may be utilized with the methods and drilling control systems according to the present disclosure.
Figure 4:
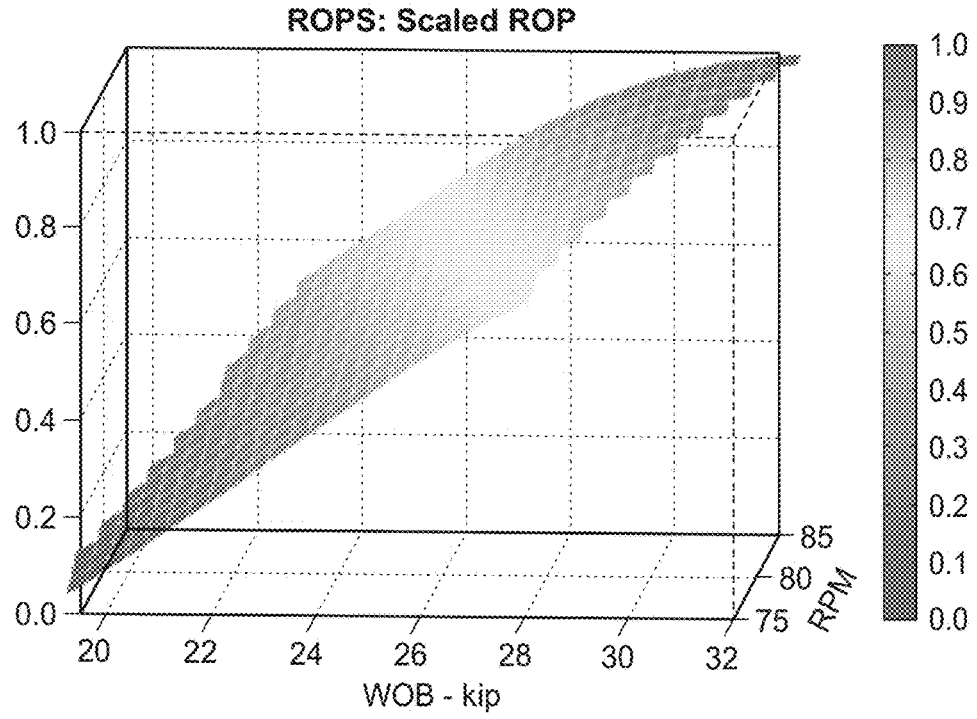
FIG. 4 is a plot illustrating scaled rate of penetration as a function of weight on bit and revolutions per minute that may be utilized with the methods and drilling control systems according to the present disclosure.

Examples of objective maps are illustrated in FIGS. 3-6. In the example of FIG. 3, rate of penetration (ROP) is plotted on a three-dimensional surface as a function of both weight on bit (WOB) and revolutions per minute (RPM). In the example of FIG. 4, the ROP data of FIG. 3 has been normalized, or scaled, such as by a maximum value of ROP from FIG. 3. Thus, the ROP data of FIG. 4 is defined between a minimum value of 0.0 and a maximum value of 1.0. Stated another way, FIGS. 3-4 illustrate objective maps in which a single estimated drilling performance indicator (ROP) is plotted as a function of two independent operational parameters (WOB and RPM). The objective map of FIG. 4 may be referred to herein as a normalized objective map.

Figure 5:
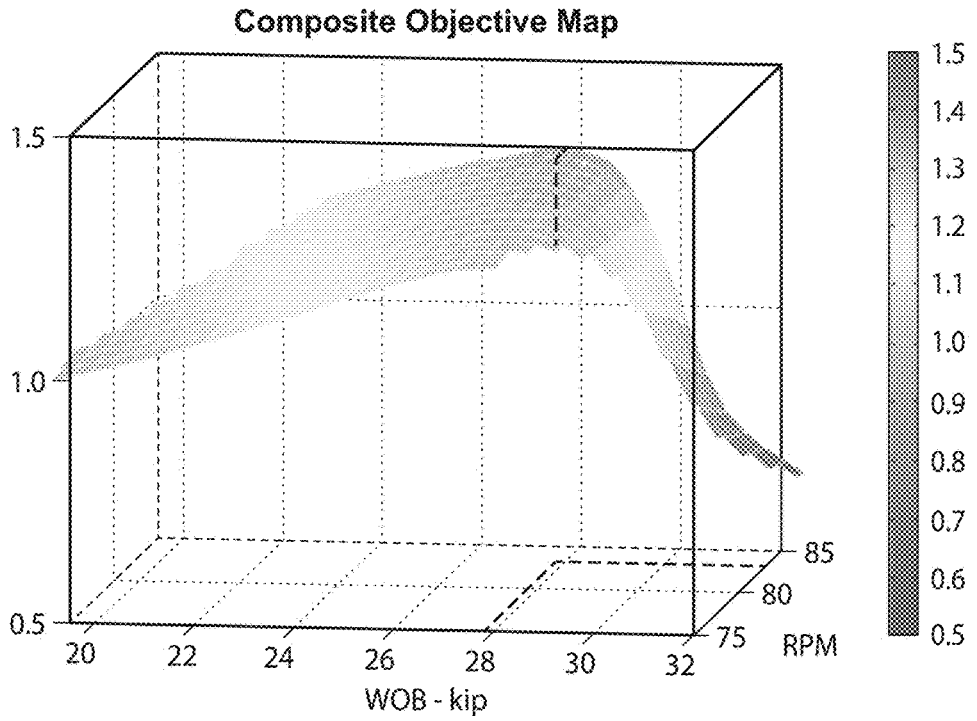
FIG. 5 is a plot illustrating an objective map that may be utilized with the methods and drilling control systems according to the present disclosure.

When the objective map includes the plurality of drilling performance indicators, the plurality of drilling performance indicators may be combined to generate the objective map. Such an objective map also may be referred to herein as a composite objective map, an example of which is illustrated in FIG. 5. In the composite objective map, a value of each drilling performance indicator in the plurality of drilling performance indicators may be combined at each value of the at least one independent operational parameter. Prior to being combined, the value of each drilling performance indicator in the plurality of drilling performance indicators may be scaled and/or combined in any suitable manner. Examples of composite objective maps and/or of methods of generating composite objective maps are disclosed in U.S. Patent Application Publication No. 2017/0058657, the complete disclosure of which is hereby incorporated by reference.

Figure 6:
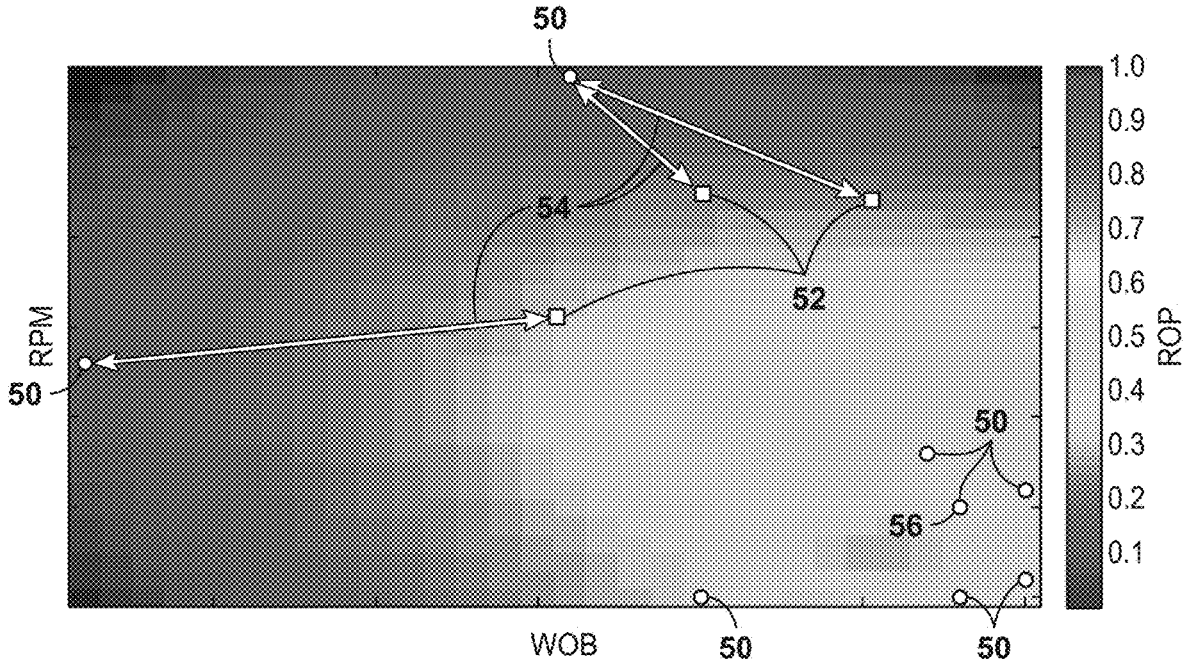
FIG. 6 is a plot illustrating a response surface that may be utilized with the methods and drilling control systems according to the present disclosure.

Another example of an objective map, which illustrates ROP as a function of both WOB and RPM, is illustrated in FIG. 6. In the example of FIG. 6, different values of ROP are illustrated as different colors in a 2-dimensional plane that defines various values of WOB and RPM.

Calculating critical points at 220 may include calculating a plurality of critical points, or even every critical point, of, on, and/or within the objective map. Examples of the critical points include inflection points of the objective map, relative maxima of the objective map, relative minima of the objective map, and/or saddle points of the objective map. With this in mind, the calculating at 220 may include determining where, on the objective map, a derivative and/or a second derivative of the at least one estimated drilling performance indicator with respect to the at least one independent operational parameter is equal to zero.

The calculating at 220 is illustrated in FIG. 6, with critical points 50 being designated by circles on the surface that defines ROP as a function of RPM and WOB. In the example of FIG. 6, critical points 50 designate all inflection points, relative maxima, relative minima, and saddle points that occur in the plot of ROP as a function of RPM and WOB.

Figure 7:
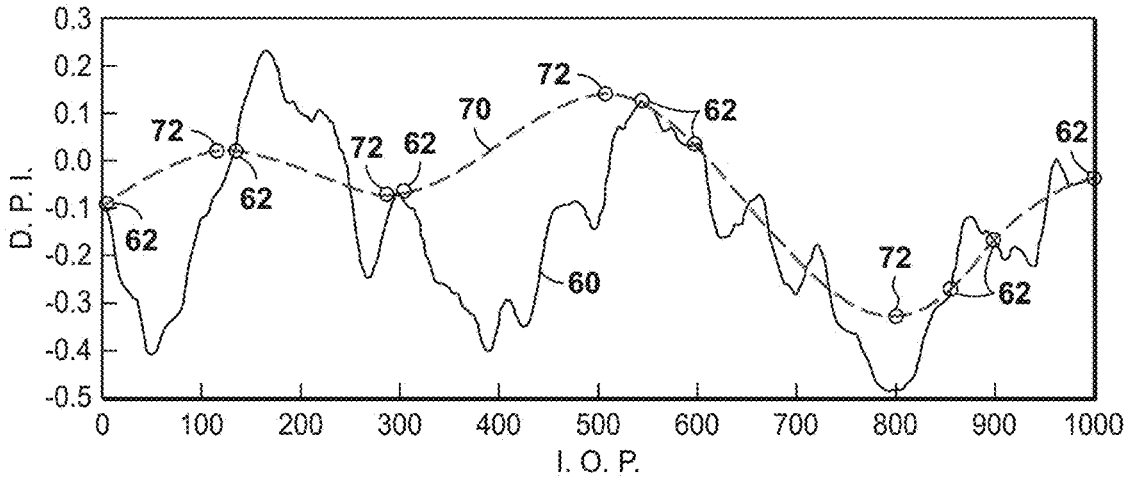
FIG. 7 is a plot illustrating filtering that may be utilized with the methods and drilling control systems according to the present disclosure.
Figure 8:
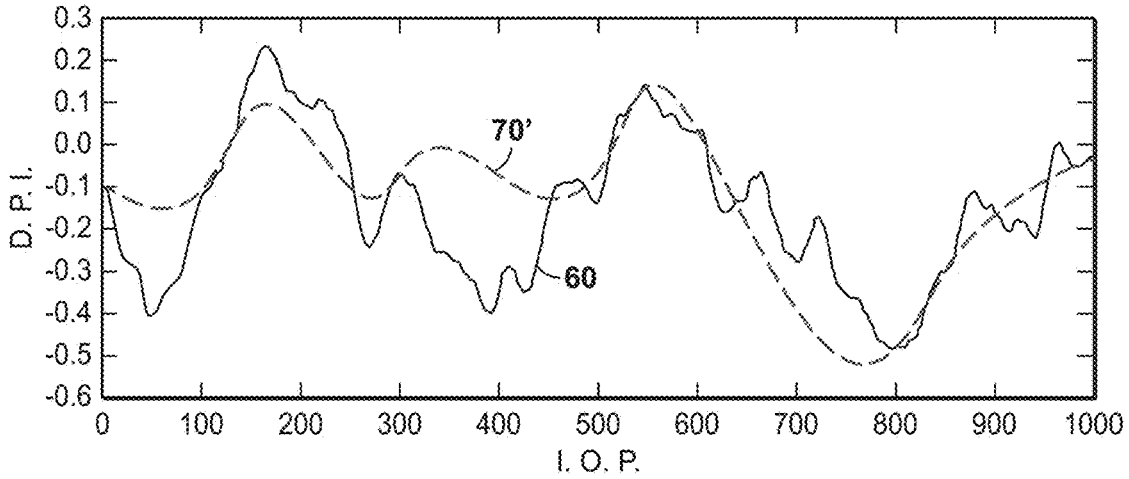
FIG. 8 is another plot illustrating filtering that may be utilized with the methods and drilling control systems according to the present disclosure.
Figure 9:
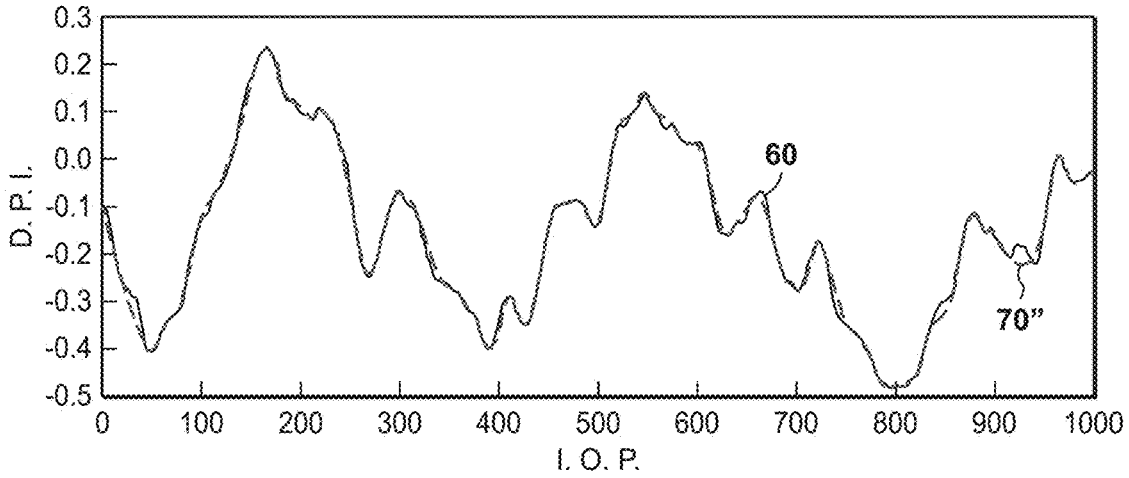
FIG. 9 is another plot illustrating filtering that may be utilized with the methods and drilling control systems according to the present disclosure.

The process via which the calculating at 220 may be utilized to improve the estimate of the actual value of the at least one drilling performance indicator that is provided by the objective map is illustrated in FIGS. 7-9. As illustrated therein, an actual value of a drilling performance indicator (D.P.I.) as a function of an independent operational parameter (I.O.P.), which initially may not be known, is indicated at 60. Initially, and as illustrated in FIG. 7 several (a total of eight in FIG. 7) data points 62 may be measured and/or experimentally determined. Data points 62 then may be fit to a curve 70, which also may be referred to herein as an objective map and estimates a value of the drilling performance indicator for each value of the independent operational parameter. Critical points 72 of curve 70 then may be calculated and fit with a new curve to provide an updated curve 70', as illustrated in FIG. 8. In general, updated curve 70' will provide an improved estimate of the actual value of the drilling performance indicator. This process may be repeated, quickly causing a curve 70" to converge upon actual data 60, as illustrated in FIG. 9.

Scoring each critical point at 230 may include scoring each critical point of the plurality of critical points and/or generating a corresponding score for each critical point of the plurality of critical points. The scoring at 230 may be based, at least in part, on, or on a relative magnitude of, an ExplorationTerm and an ExploitationTerm for each critical point. As an example, the scoring at 230 may include summing the ExplorationTerm and the ExploitationTerm, such as according to equation (1), to arrive at the score for each critical point.

$$\text{Score}_i=\text{ExplorationTerm}_i+\text{ExploitationTerm}_i \quad (1)$$

The ExplorationTerm may favor performing the operating at 250 in unexplored regions of the objective map (e.g., the exploratory mode), in regions of the objective map that do not include a data point, or in regions of the objective map that do not include a nearby data point. The ExplorationTerm may dominate the Score in situations in which the estimated drilling performance indicator, as provided by the objective map, differs significantly from an actual, or experimentally determined, value of the drilling performance indicator.

As an example, the objective map may include and/or may be based, at least in part, on a plurality of experimentally determined data points, as indicated by squares at 52 in FIG. 6. Under these conditions, the ExplorationTerm for a given critical point in the plurality of critical points may be a product of an ErrorWeight factor and a DistWeight factor, such as according to equation (2).

$$\text{ExplorationTerm}_i=(\text{ErrorWeight}_i)(\text{DistWeight}_i) \quad (2)$$

In equation (2), $\text{ErrorWeight}_i$ includes a measure of a change from a prior objective map to a current objective map, and $\text{DistWeight}_i$ includes a magnitude of a distance between a given critical point 50 and a closest experimentally determined data point 52 of the plurality of experimentally determined data points. As a more specific example, $\text{ErrorWeight}_i$ may be equal to a magnitude of a difference between an average value of the prior objective map and an average value of the current objective map. As another more specific example, $\text{DistWeight}_i$ for the given critical point may be equal to the distance 54 between the given critical point 50 and the closest experimentally determined data point 52 as measured along at least one axis defined by the at least one independent operational parameter, as illustrated in FIG. 6.

Thus, $\text{ExplorationTerm}_i$ may be large in situations in which there is a large change from one objective map to the next and/or in which there is a large distance between critical points and experimentally determined data points. Stated another way, $\text{ExplorationTerm}_i$ may be large, or may dominate the Score, in situations in which the behavior of the at least one drilling performance indicator as a function of the at least one independent operational parameter is not well-known and/or is not accurately predicted by the objective map.

In contrast, $\text{ExplorationTerm}_i$ may be small, or may approach zero, in situations in which there is little change from one objective map to the next and/or in which there is a small distance between critical points and experimentally determined data points. Stated another way, $\text{ExplorationTerm}_i$ may be small, or may not dominate the Score, in situations in which the behavior of the at least one drilling performance indicator as a function of the at least one independent operational parameter is well-known and/or is well-predicted by the objective map.

In contrast, the $\text{ExploitationTerm}_i$ for a given critical point may favor performing the operating at 250 in regions of the objective map that provide and/or predict a desirable value for the at least one estimated drilling performance indicator (e.g., the exploitation mode). As an example, $\text{ExploitationTerm}_i$ for the given critical point may be equal to a value of the objective map, to a value of the at least one estimated drilling performance indicator, at the given critical point. In the example of FIG. 6, $\text{ExploitationTerm}_i$ for the given critical point may be equal to the magnitude of ROP at the given critical point and/or may favor region(s) of the objective map that favor a high value for ROP. As such, a high, or maximum predicted, value for ROP will be favored in situations in which $ExplorationTerm_i$ dominates the $Score_i$.

Selecting the selected critical point at 240 may include selecting the critical point from the plurality of critical points. The selecting at 240 may be based, at least in part, on the scoring at 230. As an example, the selecting at 240 may include selecting such that a magnitude of a score for the selected critical point, such as may be determined via equation (1), is greater than a magnitude of a score for all other critical points in the plurality of critical points. In the example of FIG. 6, the selected critical point is indicated at 56. The selected critical point describes, correlates, and/or quantifies an estimated value of the at least one drilling performance indicator for a selected value of the at least one independent operational parameter of the drilling rig.

Operating the drilling rig at 250 may include operating the drilling rig at, or utilizing, the selected value of the at least one independent operational parameter. Stated another way, the operating at 250 may include increasing a length of the wellbore utilizing the drilling rig and/or the drill string thereof. During the increasing, the drilling rig may be operated, run, and/or controlled such that the at least one independent operational parameter is equal, or at least substantially equal, to the selected value of the at least one independent operational parameter as determined during the selecting at 240.

Determining the actual value of the at least one drilling performance indicator at 260 may include determining the actual value of the at least one drilling performance indicator during, concurrently with, and/or at least substantially concurrently with the operating at 250. Stated another way, the determining at 260 may include measuring the actual value of the at least one drilling performance indicator while performing the operating at 250 and/or calculating the actual value of the at least one drilling performance indicator based, at least in part, on at least one experimental variable that is measured during the operating at 250. Stated yet another way, the determining at 260 may include determining and/or measuring the actual value of the at least one drilling performance indicator that results from, or is a result of, the operating at 250.

It is within the scope of the present disclosure that the determining at 260 may include determining the actual value of the at least one drilling performance indicator in any suitable manner. As an example, the determining at 260 may include determining a single, or an instantaneous, value of the at least one drilling performance indicator.

As another example, the determining at 260 may include determining an average value of the at least one drilling performance indicator. As an example, and during the operating at 250, the determining at 260 may include collecting a plurality of experimental data points during a data collection time period. The plurality of experimental data points may be indicative of the at least one drilling performance indicator. Under these conditions, the determining at 260 may include calculating the actual value of the at least one drilling performance indicator based, at least in part, on an average of the plurality of experimental data points.

When the determining at 260 includes collecting the plurality of experimental data points, methods 200 also may include filtering the plurality of experimental data points prior to calculating the actual value of the at least one drilling performance indicator. The filtering may include filtering in any suitable manner, examples of which include applying any suitable high-pass filter, any suitable low-pass filter, and/or any suitable band-pass filter to the plurality of experimentally determined data points collected during the data collection time period.

Additionally or alternatively, and when the determining at 260 includes collecting the plurality of experimental data points, methods 200 further may include calculating a variability parameter of the plurality of experimental data points. Under these conditions, methods 200 further may include continuing the collecting the plurality of experimental data points (or increasing a magnitude of the data collection time period) until the variable parameter has less than a threshold variability parameter value. Such methods may improve an accuracy of the value of the at least one drilling performance indicator that is determined during the determining at 260.

Figure 10:
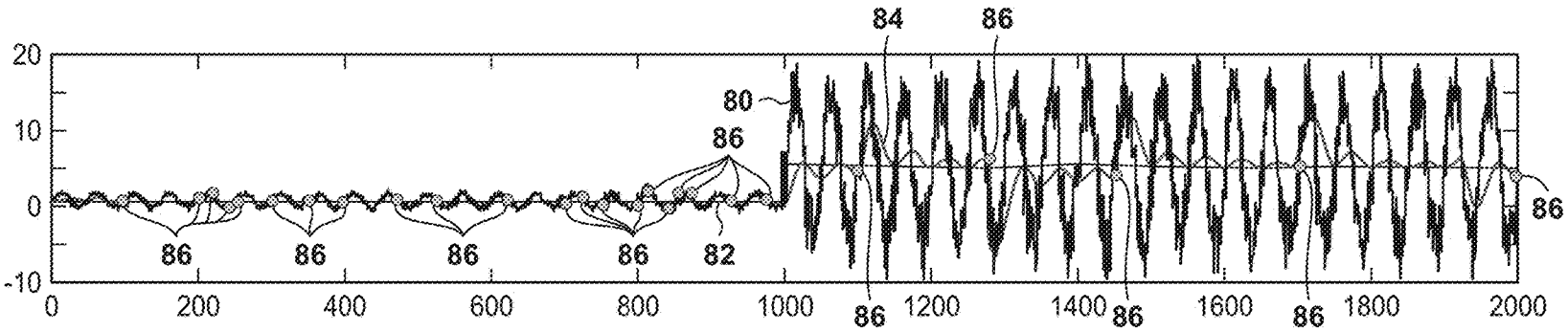
FIG. 10 is a plot illustrating data filtering that may be utilized with the methods and drilling systems according to the present disclosure.
Figure 11:
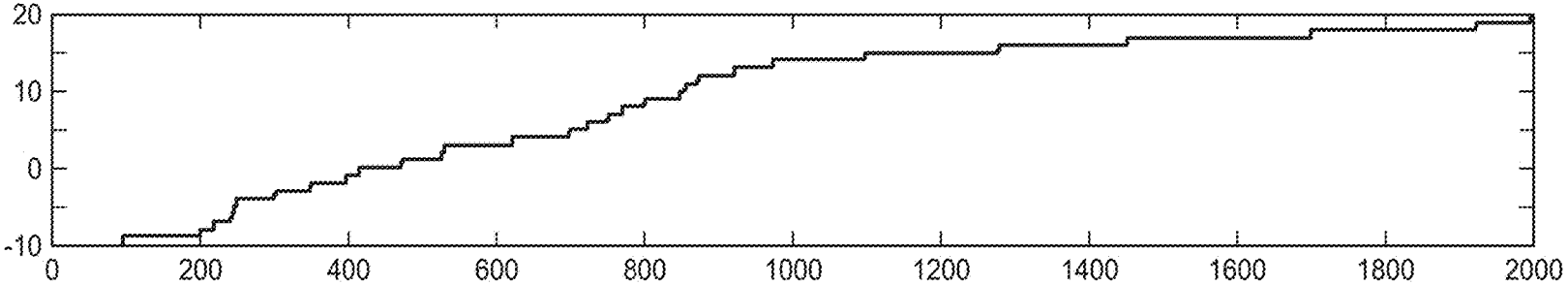
FIG. 11 is a plot illustrating data filtering that may be utilized with the methods and drilling systems according to the present disclosure.
Figure 12:
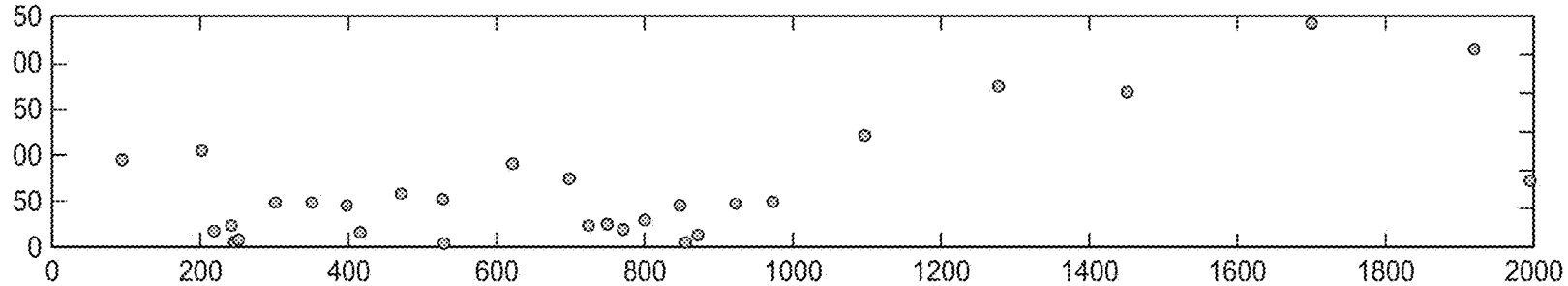
FIG. 12 is a plot illustrating data filtering that may be utilized with the methods and drilling systems according to the present disclosure.

An example of the determining at 260 is illustrated in FIGS. 10-12. FIG. 10 illustrates raw measurement data 80 as a function of time, such as might be measured during the determining at 260, for an example of a drilling performance indicator. Raw measurement data 80 has an oscillatory nature, such as might be expected when drilling through layered strata, and transitions from relatively lower-magnitude oscillations (from 0-1000 on the time scale) to relatively higher-magnitude oscillations (from 1000-2000 on the time scale). FIG. 10 also illustrates a true average 82 of the raw measurement data within the two different regions (e.g., approximately 0.0 from 0-1000 on the time scale and approximately 5 from 1000-2000 on the time scale). FIG. 10 further illustrates a running average 84 for raw measurement data 80. As may be seen from the Figure, running average 84 may differ significantly, both from raw experimental data 80 and from true average 82.

FIG. 10 also illustrates converged estimates 86 of raw experimental data 80. Converged estimates 86 are calculated by continuing collection of raw experimental data 80, during a given data collection time period, until the standard deviation of the raw experimental data collected during the given data collection time period has less than a threshold variability. Converged estimates 86 then are calculated as a mean of the raw experimental data collected during the given data collection time period. As may be seen from FIG. 10, converged estimates 86 generally provide a better estimate both of the value of raw experimental data 80 at a given point in time and of true average 82 at the given point in time.

As discussed, the determining at 260 may include collecting raw experimental data 80 during a variable-duration data collection time period. This is illustrated in FIGS. 11-12. FIG. 11 illustrates a cumulative number of estimates of raw experimental data 80 of FIG. 10 that are represented by converged estimates 86, while FIG. 12 illustrates a number of data points utilized to calculate a given converged estimate 86.

As may be seen from FIG. 11, the cumulative number of estimates increases relatively more quickly during periods of time in which raw experimental data 80 of FIG. 10 is relatively more stable, or has less relative variability. In contrast, the cumulative number of estimates increases relatively more slowly in periods of time in which raw experimental data 80 of FIG. 10 is relatively less stable, or has more relative variability.

As may be seen from FIG. 12, the number of data points utilized to calculate the given converged estimate 86 is lower during periods of time in which raw experimental data 80 of FIG. 10 is relatively more stable, or has less relative variability. In contrast, the number of data points utilized to calculate the given converged estimate 86 is higher during periods of time in which raw experimental data 80 of FIG. 10 is relatively less stable, or has more relative variability.

Updating the objective map at 270 may include updating the objective map to produce and/or generate an updated objective map. The updated objective map may be based upon the actual value of the at least one drilling performance indicator, as determined during the determining at 260, at the selected value for the at least one independent operational parameter. Stated another way, the updating at 270 may include improving an accuracy of, or improving an estimate provided by, the objective map by incorporating experimentally determined results, obtained when the drilling rig is operated at the selected value of the at least one independent operational parameter, into the updated objective map.

The objective map may be based, at least in part, on the plurality of experimentally determined data points. Under these conditions, the updating at 270 may include adding at least one additional experimentally determined data point to the plurality of experimentally determined data points to generate an expanded plurality of experimentally determined data points. The at least one additional experimentally determined data point may be based upon the actual value of the at least one drilling performance indicator, such as may be determined during the determining at 260, at the selected value of the at least one independent operational parameter, such as may be selected during the selecting at 240. Stated another way, each data point in the expanded plurality of experimentally determined data points includes a determined value of the at least one estimated drilling performance indicator for a corresponding value of the at least one independent operational parameter.

The updating at 270 may include fitting the expanded plurality of experimentally determined data points to produce and/or generate the updated objective map. The fitting may include fitting a curve, fitting a polynomial, fitting a function, fitting a differentiable function, and/or fitting a continuous function to the expanded plurality of experimentally determined data points. Additionally or alternatively, the fitting may include fitting such that the updated objective map provides a single estimated value of the at least one drilling performance indicator for each permissible value of the at least one independent operational parameter. The fitting may include fitting such that the updated objective map is normalized, or is a normalized updated objective map.

Repeating at least the portion of the methods at 280 may include repeating any suitable portion of methods 200 in any suitable manner. As an example, the repeating at 280 may include utilizing the updated objective map to repeat and/or to perform at least the calculating at 220, the scoring at 230, the selecting at 240, the operating at 250, the determining at 260, and the updating at 270. As another example, the repeating at 280 may include repeating the accessing at 210 to access the updated objective map and subsequently repeating the calculating at 220, the scoring at 230, the selecting at 240, the operating at 250, the determining at 260, and the updating at 270.

This may include repeating a plurality of times to iteratively improve an estimate of the at least one drilling performance indicator that is provided, or represented, by the updated objective map. Stated another way, the repeating at 280 may include generating a plurality of updated objective maps, with each successive, or subsequently generated, updated objective map of the plurality of updated objective maps including additional experimentally determined actual values of the at least one drilling performance indicator than a previously generated updated objective map of the plurality of updated objective maps.

The repeating at 280 additionally or alternatively may include repeating for a plurality of data collecting time periods. Under these conditions, methods 200 further may include adjusting the at least one independent operational parameter of the drilling rig responsive to a change in a given data collection time period relative to a prior data collection time period. Additionally or alternatively, methods 200 may include notifying an operator of the drilling rig of the change in the given data collection time period relative to the prior data collection time period.

Figure 13:
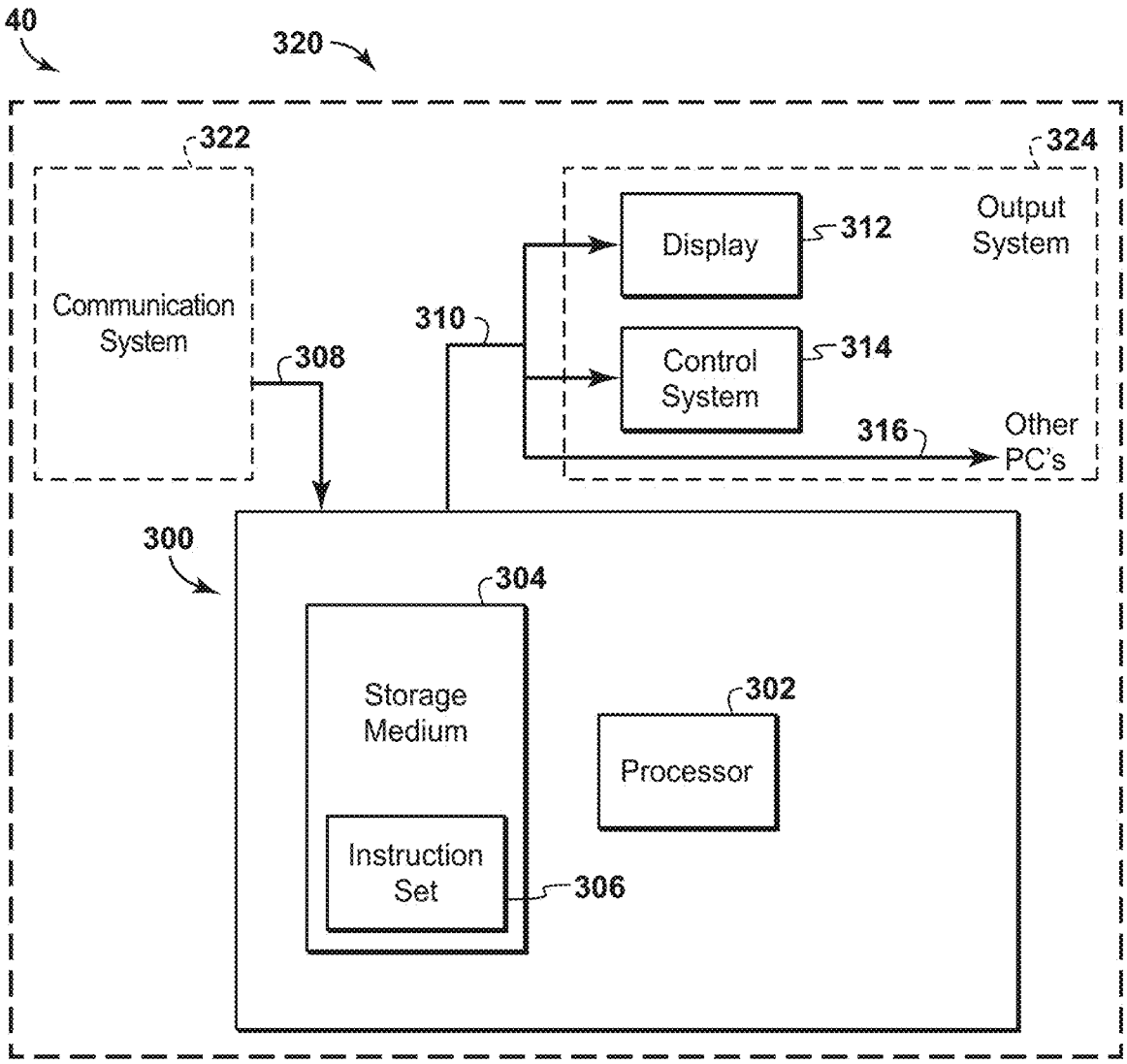
FIG. 13 is a schematic illustration of a drilling control system according to the present disclosure.

A more specific example of drilling control system 40 is illustrated in FIG. 13. In some implementations, drilling control system 40 may include and/or be a computer-based system 300 for use in association with drilling operations. The computer-based system may be a computer system, may be a network-based computing system, and/or may be a computer integrated into equipment at the drilling site. Computer-based system 300 comprises a processor 302, a storage medium 304, and at least one instruction set 306. Processor 302 is adapted to execute instructions and may include one or more processors that commonly are utilized in computing systems. Storage medium 304 also may be referred to herein as computer readable storage media 304 and/or as non-transient computer readable storage media 304. Storage medium 304 is adapted to communicate with the processor 302 and to store data and other information, including the at least one instruction set 306, which also may be referred to herein as computer-executable instructions 306. When executed, the computer-readable instructions may direct a drilling rig, such as drilling rig 24 of FIG. 1, to perform any suitable portion, step, and/or steps of any of methods 200 that are disclosed herein.

The storage medium 304 may include various forms of electronic storage mediums, including one or more storage mediums in communication in any suitable manner. The selection of appropriate processor(s) and storage medium(s) and their relationship to each other may be dependent on the particular implementation. For example, some implementations may utilize multiple processors and an instruction set adapted to utilize the multiple processors to increase the speed of the computing steps. Additionally or alternatively, some implementations may be based on a sufficient quantity or diversity of data that multiple storage mediums are desired or storage mediums of particular configurations are desired. Still additionally or alternatively, one or more of the components of the computer-based system may be located remotely from the other components and be connected via any suitable electronic communications system. For example, some implementations of the present systems and methods may refer to historical data from other wells, which may be obtained in some implementations from a centralized server connected via networking technology. One of ordinary skill in the art will be able to select and configure the basic computing components to form the computer-based system.

Computer-based system 300 of FIG. 13 is more than a processor 302 and a storage medium 304. The computer-based system 300 of the present disclosure further includes at least one instruction set 306 accessible by the processor and saved in the storage medium. The at least one instruction set 306 is adapted to perform methods 200 of FIG. 2 as described herein. As illustrated, the computer-based system 300 may receive data at data input 308 and may export data at data export 310. The data input and output ports can be serial ports (DB-9 RS232), LAN, wireless network, etc. The at least one instruction set 306 is adapted to export the generated operational recommendations for consideration in controlling drilling operations.

In some implementations, the generated operational recommendations may be exported to a display 312 for consideration by a user, such as a driller. In other implementations, the generated operational recommendations may be provided as an audible signal, such as up or down chimes of different characteristics to signal a recommended increase or decrease of WOB, RPM, or some other independent operational parameter of the drilling operation. In a modern drilling system, the driller is tasked with monitoring of onscreen indicators, and audible indicators, alone or in conjunction with visual representations, may be an effective method to convey the generated recommendations. The audible indicators may be provided in any suitable format, including chimes, bells, tones, verbalized commands, etc. Verbal commands, such as by computer-generated voices, are readily implemented using modern technologies and may be an effective way of ensuring that the right message is heard by the driller. Additionally or alternatively, the generated operational recommendations may be exported to a control system 314 adapted to determine at least one operational update. Control system 314 may be integrated into the computer-based system or may be a separate component. Additionally or alternatively, control system 314 may be adapted to implement at least one of the determined updates during the drilling operation, automatically, substantially automatically, or upon user activation.

Continuing with the discussion of FIG. 13, some implementations of the present technologies may include drilling rig systems or components of the drilling rig system. For example, the present systems may include a drilling rig system 320 that includes the computer-based system 300 described herein. The drilling rig system 320 of the present disclosure may include a communication system 322 and an output system 324. The communication system 322 may be adapted to receive data regarding independent operational parameters of the drilling rig and/or drilling performance indicators of the drilling rig that may be relevant to ongoing drilling operations. The output system 324 may be adapted to communicate the generated operational recommendations and/or the determined operational updates for consideration in controlling drilling operations. The communication system 322 may receive data from other parts of an oil field, from the rig and/or wellbore, and/or from another networked data source, such as the Internet. The output system 324 may be adapted to include displays 312, printers, control systems 314, other computers 316, a network at the rig site, or other means of exporting the generated operational recommendations and/or the determined operational updates. The other computers 316 may be located at the rig or in remote offices.

In some implementations, control system 314 may be adapted to implement at least one of the determined operational updates at least substantially automatically. As described above, the present methods and systems may be implemented in any variety of drilling operations. Accordingly, drilling rig systems adapted to implement the methods described herein to optimize drilling performance are within the scope of the present disclosure. For example, various steps of the presently disclosed methods may be done utilizing computer-based systems and algorithms and the results of the presently disclosed methods may be presented to a user for consideration via one or more visual displays, such as monitors, printers, etc., or via audible prompts, as described herein. Accordingly, drilling equipment including or communicating with computer-based systems adapted to perform the presently described methods are within the scope of the present disclosure.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the well drilling industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of drilling a wellbore within a subsurface region and with a drill string of a drilling rig, the method comprising:

accessing an objective map that describes at least one estimated drilling performance indicator of the drilling rig as a function of at least one independent operational parameter of the drilling rig, wherein the accessing the objective map includes drilling, with the drill string, an initial portion of the wellbore, wherein the drilling the initial portion of the wellbore includes:

(i) varying the at least one independent operational parameter over a plurality of independent operational parameter values;

(ii) collecting the actual value of the at least one drilling performance indicator for each of the plurality of independent operational parameter values; and (iii) generating the objective map based upon the actual value of the at least one drilling performance indicator for each of the plurality of independent operational parameter values;

calculating a plurality of critical points of the objective map;

scoring each critical point of the plurality of critical points;

selecting a selected critical point of the plurality of critical points based, at least in part, on the scoring, wherein the selected critical point describes an estimated value of the at least one estimated drilling performance indicator for a selected value of the at least one independent operational parameter;

operating the drilling rig at the selected value of the at least one independent operational parameter;

during the operating the drilling rig, determining an actual value of at least one drilling performance indicator;

updating the objective map to generate an updated objective map based upon the actual value of the at least one drilling performance indicator at the selected value of the at least one independent operational parameter; and repeating, with the updated objective map, at least the calculating the plurality of critical points, the scoring each critical point, the selecting the selected critical point, the operating the drilling rig at the selected value of the at least one independent operational parameter, the determining the actual value of the at least one drilling performance indicator, and the updating the objective map a plurality of times to iteratively improve an estimate of the at least one drilling performance indicator provided by the updated objective map.

2. The method of claim 1, wherein the drilling the initial portion of the wellbore includes:

(i) maintaining a fixed value of the at least one independent operational parameter for at least a threshold drilling time; and (ii) collecting a plurality of intermediate values of the at least one drilling performance indicator during the threshold drilling time, wherein the actual value of the at least one drilling performance indicator is based upon the plurality of intermediate values of the at least one drilling performance indicator.

3. The method of claim 1, wherein the at least one independent operational parameter includes at least one of:

(i) a revolutions per minute of the drill string (RPM);

(ii) a weight-on-bit (WOB) applied, by the drill string, to a drill bit of the drill string;

(iii) a flow rate of drilling mud; and (iv) a pressure differential of the drilling mud across the drill bit.

4. The method of claim 1, wherein the at least one drilling performance indicator includes at least one of:

(i) a rate of penetration (ROP) of the drill string into a subterranean formation;

(ii) a mechanical specific energy (MSE) of the drilling rig while drilling the wellbore;

(iii) a hole cleaning indicator of the wellbore;

(iv) a vibrational dysfunction of the drilling rig while drilling the wellbore;

(v) a torsional severity estimate (TSE) of the drilling rig while drilling the wellbore;

(vi) a drill bit wear parameter;

(vii) a bottom hole assembly wear parameter;

(viii) a depth of cut (DOC);

(ix) a ratio of DOC to WOB;

(x) a torque applied to the drill bit while drilling the wellbore; and (xi) a vibration of the drill bit while drilling the wellbore.

5. The method of claim 1, wherein the objective map is at least one of:

(i) a two-dimensional objective map that describes the at least one estimated drilling performance indicator as a function of a single independent operational parameter;

(ii) a three-dimensional objective map that describes the at least one estimated drilling performance indicator as a function of two distinct independent operational parameters; and (iii) a three-dimensional objective map that describes rate of penetration (ROP) as a function of both weight on bit (WOB) and revolutions per minute (RPM).

6. The method of claim 1, wherein the objective map includes a fit to a plurality of data points.

7. The method of claim 6, wherein each data point in the plurality of data points includes a determined value of the at least one estimated drilling performance indicator for a corresponding value of the at least one independent operational parameter.

8. The method of claim 6, wherein the fit includes at least one of:

(i) a curve fit;

(ii) a polynomial fit;

(iii) a functional fit;

(iv) a differentiable function; and (v) a continuous function.

9. The method of claim 1, wherein the calculating the plurality of critical points includes determining at least one of:

(i) one or more inflection points of the objective map;

(ii) one or more relative maxima of the objective map;

(iii) one or more relative minima of the objective map; and (iv) one or more saddle points of the objective map.

10. The method of claim 1, wherein the scoring each critical point includes scoring based, at least in part, on a relative magnitude of an ExplorationTerm, which favors performing the operating the drilling rig in unexplored regions of the objective map, and an ExploitationTerm, which favors performing the operating the drilling rig in regions of the objective map that provide a high rate of penetration (ROP) for the drill string, for each critical point.

11. The method of claim 1, wherein the selecting the selected critical point includes selecting such that a magnitude of a score of the selected critical point is greater than a magnitude of a score of all other critical points in the plurality of critical points.

12. The method of claim 1, wherein the determining the actual value of the at least one drilling performance indicator includes collecting, during the operating the drilling rig, a plurality of experimental data points, which is indicative of the at least one drilling performance indicator, during a data collection time period, and further wherein the method includes calculating the actual value of the at least one drilling performance indicator based, at least in part, on an average of the plurality of experimental data points.

13. The method of claim 12, wherein the method further includes filtering the plurality of experimental data points prior to the calculating the actual value of the at least one drilling performance indicator.

14. The method of claim 12, wherein the method further includes calculating a variability parameter of the plurality of experimental data points and continuing the collecting the plurality of experimental data points until the variability parameter has less than a threshold variability parameter value.

15. The method of claim 1, wherein the objective map is based, at least in part, on a plurality of experimentally determined data points, wherein the updating the objective map includes adding an additional experimentally determined data point, which is based upon the actual value of the at least one drilling performance indicator at the selected value of the at least one independent operational parameter, to the plurality of experimentally determined data points to generate an expanded plurality of experimentally determined data points, and further wherein the updating the objective map includes fitting the expanded plurality of experimentally determined data points to generate the updated objective map.

16. The method of claim 1, wherein the repeating includes utilizing the updated objective map to perform the calculating the plurality of critical points, the scoring each critical point, the selecting the selected critical point, the operating the drilling rig at the selected value of the at least one independent operational parameter, the determining the actual value of the at least one drilling performance indicator, and the updating the objective map.

17. Non-transitory computer readable storage media including computer-executable instructions that, when executed, direct a drilling control system to perform the method of claim 1.

18. A well, comprising:

a wellbore extending within a subsurface region;

a drilling rig including a drill string extending within the wellbore, wherein the drill string includes:

(i) a bottom hole assembly;

(ii) a drill bit; and (iii) at least one detector configured to detect at least one parameter indicative of a drilling performance indicator of the drill string; and a drilling control system programmed to control the operation of the drilling rig according to the method of claim 1.

19. A method of drilling a wellbore within a subsurface region and with a drill string of a drilling rig, the method comprising:

accessing an objective map that describes at least one estimated drilling performance indicator of the drilling rig as a function of at least one independent operational parameter of the drilling rig;

calculating a plurality of critical points of the objective map;

scoring each critical point of the plurality of critical points, wherein the scoring each critical point includes scoring based, at least in part, on a relative magnitude of an ExplorationTerm, which favors performing the operating the drilling rig in unexplored regions of the objective map, and an ExploitationTerm, which favors performing the operating the drilling rig in regions of the objective map that provide a high rate of penetration (ROP) for the drill string, for each critical point;

selecting a selected critical point of the plurality of critical points based, at least in part, on the scoring, wherein the selected critical point describes an estimated value of the at least one estimated drilling performance indicator for a selected value of the at least one independent operational parameter;

operating the drilling rig at the selected value of the at least one independent operational parameter;

during the operating the drilling rig, determining an actual value of at least one drilling performance indicator;

updating the objective map to generate an updated objective map based upon the actual value of the at least one drilling performance indicator at the selected value of the at least one independent operational parameter; and repeating, with the updated objective map, at least the calculating the plurality of critical points, the scoring each critical point, the selecting the selected critical point, the operating the drilling rig at the selected value of the at least one independent operational parameter, the determining the actual value of the at least one drilling performance indicator, and the updating the objective map a plurality of times to iteratively improve an estimate of the at least one drilling performance indicator provided by the updated objective map.

20. The method of claim 19, wherein the scoring each critical point includes summing the ExplorationTerm for each critical point and the ExploitationTerm for each critical point to arrive at a score for each critical point.

21. The method of claim 19, wherein the objective map is based, at least in part, on a plurality of experimentally determined data points, and further wherein the ExplorationTerm for a given critical point in the plurality of critical points is a product of an ErrorWeight factor, which includes a measure of a change from a prior objective map to a current objective map, and a DistWeight factor for the given critical point, which includes a magnitude of a distance between the given critical point and a closest experimentally determined data point of the plurality of experimentally determined data points.

22. The method of claim 21, wherein the ErrorWeight factor is equal to a magnitude of a difference between an average value of the prior objective map and an average value of the current objective map.

23. The method of claim 21, wherein the DistWeight factor for the given critical point is equal to the distance between the given critical point and the closest experimentally determined data point as measured along at least one axis defined by the at least one independent operational parameter.

24. The method of claim 19, wherein the ExploitationTerm for a given critical point in the plurality of critical points is equal to a value of the objective map at the given critical point.

25. A method of drilling a wellbore within a subsurface region and with a drill string of a drilling rig, the method comprising:

accessing an objective map that describes at least one estimated drilling performance indicator of the drilling rig as a function of at least one independent operational parameter of the drilling rig;

calculating a plurality of critical points of the objective map;

scoring each critical point of the plurality of critical points;

selecting a selected critical point of the plurality of critical points based, at least in part, on the scoring, wherein the selected critical point describes an estimated value of the at least one estimated drilling performance indicator for a selected value of the at least one independent operational parameter, and wherein the selecting the selected critical point includes selecting such that a magnitude of a score of the selected critical point is greater than a magnitude of a score of all other critical points in the plurality of critical points;

operating the drilling rig at the selected value of the at least one independent operational parameter;

during the operating the drilling rig, determining an actual value of at least one drilling performance indicator;

updating the objective map to generate an updated objective map based upon the actual value of the at least one drilling performance indicator at the selected value of the at least one independent operational parameter; and repeating, with the updated objective map, at least the calculating the plurality of critical points, the scoring each critical point, the selecting the selected critical point, the operating the drilling rig at the selected value of the at least one independent operational parameter, the determining the actual value of the at least one drilling performance indicator, and the updating the objective map a plurality of times to iteratively improve an estimate of the at least one drilling performance indicator provided by the updated objective map.

26. A method of drilling a wellbore within a subsurface region and with a drill string of a drilling rig, the method comprising:

accessing an objective map that describes at least one estimated drilling performance indicator of the drilling rig as a function of at least one independent operational parameter of the drilling rig;

calculating a plurality of critical points of the objective map;

scoring each critical point of the plurality of critical points;

selecting a selected critical point of the plurality of critical points based, at least in part, on the scoring, wherein the selected critical point describes an estimated value of the at least one estimated drilling performance indicator for a selected value of the at least one independent operational parameter;

operating the drilling rig at the selected value of the at least one independent operational parameter;

during the operating the drilling rig, determining an actual value of at least one drilling performance indicator, wherein the determining the actual value of the at least one drilling performance indicator includes collecting, during the operating the drilling rig, a plurality of experimental data points, which is indicative of the at least one drilling performance indicator, during a data collection time period, and further wherein the method includes calculating the actual value of the at least one drilling performance indicator based, at least in part, on an average of the plurality of experimental data points;

updating the objective map to generate an updated objective map based upon the actual value of the at least one drilling performance indicator at the selected value of the at least one independent operational parameter; and repeating, with the updated objective map, at least the calculating the plurality of critical points, the scoring each critical point, the selecting the selected critical point, the operating the drilling rig at the selected value of the at least one independent operational parameter, the determining the actual value of the at least one drilling performance indicator, and the updating the objective map a plurality of times to iteratively improve an estimate of the at least one drilling performance indicator provided by the updated objective map, wherein the method further includes calculating a variability parameter of the plurality of experimental data points and continuing the collecting the plurality of experimental data points until the variability parameter has less than a threshold variability parameter value.

27. A method of drilling a wellbore within a subsurface region and with a drill string of a drilling rig, the method comprising:

accessing an objective map that describes at least one estimated drilling performance indicator of the drilling rig as a function of at least one independent operational parameter of the drilling rig;

calculating a plurality of critical points of the objective map;

scoring each critical point of the plurality of critical points;

selecting a selected critical point of the plurality of critical points based, at least in part, on the scoring, wherein the selected critical point describes an estimated value of the at least one estimated drilling performance indicator for a selected value of the at least one independent operational parameter;

operating the drilling rig at the selected value of the at least one independent operational parameter;

during the operating the drilling rig, determining an actual value of at least one drilling performance indicator;

updating the objective map to generate an updated objective map based upon the actual value of the at least one drilling performance indicator at the selected value of the at least one independent operational parameter; and repeating, with the updated objective map, at least the calculating the plurality of critical points, the scoring each critical point, the selecting the selected critical point, the operating the drilling rig at the selected value of the at least one independent operational parameter, the determining the actual value of the at least one drilling performance indicator, and the updating the objective map a plurality of times to iteratively improve an estimate of the at least one drilling performance indicator provided by the updated objective map; and wherein the objective map is based, at least in part, on a plurality of experimentally determined data points, wherein the updating the objective map includes adding an additional experimentally determined data point, which is based upon the actual value of the at least one drilling performance indicator at the selected value of the at least one independent operational parameter, to the plurality of experimentally determined data points to generate an expanded plurality of experimentally determined data points, and further wherein the updating the objective map includes fitting the expanded plurality of experimentally determined data points to generate the updated objective map.

* * * * *